US005823237A

United States Patent [19]

Alvern et al.

[11] Patent Number: 5,823,237

[45] Date of Patent: Oct. 20, 1998

[54] PROTECTIVE COVER FOR A FUEL PUMP FILLER GUN AND METHOD FOR PROTECTING SAME

[75] Inventors: Stein Alvern, Houston, Tex.; Øyvind Alvern, Hjellestad, Norway

[73] Assignee: Alvern-Norway A/S, Oslo, Norway

[21] Appl. No.: 757,096

[22] Filed: Dec. 2, 1996

Related U.S. Application Data

[63] Continuation-in-part of Ser. No. 678,848, Jul. 12, 1996, which is a continuation-in-part of Ser. No. 669,228, Jun. 24, 1996.

[51] Int. Cl.[6] ..... B67D 5/37

[52] U.S. Cl. ..... 141/392; 137/379; D23/227; 239/288; 206/521; 206/592

[58] Field of Search ..... 141/98, 392; 137/379; 150/154, 160–162; 206/521, 591, 592; 74/558.5; D23/227; 239/288–288.5

[56] References Cited

U.S. PATENT DOCUMENTS

| | | | |
|---|---|---|---|
| D. 173,007 | 9/1954 | Anderson | D23/227 |
| D. 175,697 | 9/1955 | Sutcliffe | D23/227 |
| D. 287,996 | 1/1987 | Carder, Sr. | D23/227 |
| D. 349,559 | 8/1994 | Vanderhoef et al. | D23/227 |
| 1,733,262 | 10/1929 | Higby . | |
| 2,236,208 | 3/1941 | Creel . | |
| 2,524,509 | 10/1950 | Barney | 137/379 |
| 2,643,668 | 6/1953 | Ackermann . | |
| 2,800,931 | 7/1957 | Sutcliffe | 141/392 |
| 3,016,763 | 1/1962 | Albert | 74/558.5 |
| 3,228,445 | 1/1966 | Mayotte | 150/154 |
| 3,327,280 | 6/1967 | Levine et al. | 150/154 |
| 3,445,051 | 5/1969 | Goldman | 206/521 |
| 3,474,837 | 10/1969 | Carder et al. | 141/392 |
| 3,566,928 | 3/1971 | Hansel . | |
| 4,197,611 | 4/1980 | Bell et al. | 74/558.5 |
| 4,465,209 | 8/1984 | Wilder | 222/23 |
| 4,624,364 | 11/1986 | Swain | 206/591 |
| 4,696,401 | 9/1987 | Wallace | 206/591 |
| 5,184,655 | 2/1993 | Fell . | |
| 5,332,156 | 7/1994 | Wheeler | 239/288 |
| 5,383,091 | 1/1995 | Snell | 150/154 |
| 5,509,452 | 4/1996 | Tammera | 141/392 |

FOREIGN PATENT DOCUMENTS

| | | |
|---|---|---|
| 980890 | 1/1965 | United Kingdom . |
| WO 94/04457 | 3/1994 | WIPO . |
| WO 97/19015 | 5/1997 | WIPO . |

*Primary Examiner*—J. Casimer Jacyna
*Attorney, Agent, or Firm*—Finnegan, Henderson, Farabow, Garrett & Dunner, L.L.P.

[57] ABSTRACT

A protective apparatus for use with a filler gun having in sequence a barrel, a head, and a handle, includes a protective body. The protective body includes an outer shell surrounding at least a portion of the filler gun. The outer layer is made of a hard material so as to resist scratching, absorb the initial impact, and distribute the forces away from the filler gun. A pair of arcuate ribs are provided between the filler gun and outer shell to assist in the distribution of impact forces, absorb direct impacts, and act as spacers between the outer shell and the filler gun.

15 Claims, 20 Drawing Sheets

PROTECTIVE COVER FOR A FUEL PUMP FILLER GUN AND METHOD FOR PROTECTING SAME

BACKGROUND OF THE INVENTION

This application is a continuation-in-part of patent application Ser. No. 08/678,848, entitled "Protective Cover For a Fuel Pump Filler Gun," filed Jul. 12, 1996, still pending which is a continuation-in-part of patent application Ser. No. 08/669,228, filed Jun. 24, 1996, still pending.

1. Field of the Invention

The present invention relates to protection devices, and more particularly to a protection apparatus having an energy absorbing inner layer, a harder outer layer surrounding the inner layer, and being attachable to filler gun for, e.g., a fuel pump, an oil pump, a windshield washer pump, an antifreeze pump, or the like. The protection apparatus absorbs and distributes impact forces otherwise received directly by the filler gun when dropped or hit against an object.

2. Description of the Related Art

Related art devices are known to have the head of a filler gun covered by a thin boot of rubber or plastic material. The boot prevents a bare filler gun head from making scratches on a car's paint, and to a limited degree protects the head from damage. Even with a boot covering the head, however, impact forces caused by the filler guns being dropped upon the ground, or being hit against the pump, automobiles, and other objects, results in damaged filler guns. Repairing and replacing filler guns are one of the direct costs of such damage. The gas station operator also may lose business as a result of having certain pumps out of order while awaiting repair.

A need exists for a protection apparatus which may be readily attached to all configurations of filler guns, whether or not the filler gun has a boot covering the head. The protection apparatus should be readily attachable to the head of a filler gun, or to a boot covering the head of a filler gun, to provide significant protection to the filler gun, thereby avoiding the costs associated with pump downtime, and filler gun repair and replacement.

SUMMARY OF THE INVENTION

Accordingly, the present invention is directed to a protection apparatus that overcomes the limitations and disadvantages of the related art.

An advantage of the present invention is its simple design that is nevertheless capable of providing a protection apparatus that may be readily attached to all existing configurations of filler guns for protection from damage otherwise resulting from impact forces.

Additional features and advantages of the invention will be set forth in the description which follows, and in part will be apparent from the description, or may be learned by practice of the invention. The objects and other advantages of the invention will be realized and attained by the protection apparatus particularly pointed out in the written description and claims hereof as well as the appended drawings.

To achieve these and other advantages in accordance with the purposes of the invention, as embodied and broadly described, the invention comprises an energy absorbing inner layer surrounding a portion of the filler gun to protect the filler gun from impact forces. An outer layer surrounds at least a portion of the inner layer to distribute impact forces over the inner layer. The outer layer is harder than the inner layer so as to resist scratching, absorb the initial impact, and distribute the forces over the softer inner layer. The invention preferably includes attachment means for attaching the inner and outer layers to the filler gun.

In one embodiment, the protective apparatus is configured for use with a filler gun having a boot covering at least a portion of the head. In this embodiment, the attachment means preferably attaches the protective apparatus to the boot. However, the invention is not limited to use only with filler guns protected by a boot. The protective apparatus of the present invention permits attachment either to the head of a filler gun, or to a boot covering the head of the filler gun.

In another embodiment of the present invention the inner and outer layers form a protective body. The protective body may be formed from various materials, and the attachment means can be any substance or device for securing the protective body to the filler gun. Preferably, the outer layer is made of molded plastic or a substantially hard plastic. The preferred hard plastic is either polyamide or polycarbonate. A preferred inner layer is selected from at least one of rubber, foam, plastic, a bladder containing liquid, and a bladder containing gas. An alternative embodiment of the inner layer includes at least two layers each selected from one of the above preferred materials. In this alternative embodiment the preferred two layers of the inner layer are made of different materials. Yet another alternative embodiment of the inner layer includes an upholstery or mattress material.

The attachment means may include straps, adhesives, anchors and screws, pins, or hooks. When used with a boot, one preferred attachment means includes pins having a hooked head for penetrating the boot. When the display holder is attached directly to the filler gun head, one preferred attachment means is a strap. A preferred attachment means utilized with either a bare head or head covered with a boot may be integrally formed into one or both of the inner and outer layers.

In yet another embodiment, the protective body has a first body portion and a second body portion hingedly connected together. The attachment means includes a first member connected to the first body portion and a second member connected to the second body portion. The first member releasably engages with the second member to secure the protective body to the filler gun. The preferred first member is formed as a male element in the form of snap hooks, and the second member is formed as a female element having means for receiving and releasably engaging the hooks.

According to another embodiment, the protective body is divided into at least two parts configured to cover impact points on the filler gun or extend above the impact points. The filler gun impact points are first to contact when the filler gun is dropped at various angles.

In another alternative, the protective body adapts to be fitted onto a filler gun and extends over at least a portion of the head of the filler gun. In this embodiment, the inner and outer layers form a layered shield, which is divided into a first member and a second member. Means for releasably interconnecting the first and second members are shaped to generally conform, when so interconnected, to enclose the sides, bottom, and the upper portions of the head of the filler gun.

Alternatively, the protective body may include a lower member and a upper member for releasably engaging with the lower member. The lower member has two side panels and means for interconnecting the side panels. The lower member, when the two side panels are brought to lie against the head of the filler gun, substantially fit around a lower part of the head. The side panels have at a top region thereof first interlocking means. The upper member is formed to fit over an upper part of the head of the filler gun, and has second interlocking means for releasable engaging the first interlocking means on the lower member. Preferably, the two side panels are integrally joined at a front region thereof. The preferred front region is above and below a front opening in the lower member through which the barrel extends. A preferred interconnecting means includes snap-locks. Another preferred interconnecting means is a bottom element attached to the panels by hinges. The panels, bottom element, first interlocking means, and lower member preferably are formed as an integral structure.

Another embodiment includes a protective sleeve to slidably engage a filler gun. The invention includes an energy absorbing inner layer, adapted to slidably engage the head, having respective ends, one end to receive the barrel and the other end to receive the handle. An outer layer surrounds at least a portion of the inner layer to distribute impact forces over the inner layer.

Another embodiment of the invention includes an outer shell and a pair of ribs having an arcuate cross-section, projecting away from an inner surface of the outer shell and bearing against the sides of the filler gun.

It is to be understood that both the foregoing general description and the following detailed descriptions are exemplary only, and are not restrictive of the invention.

BRIEF DESCRIPTION OF THE DRAWINGS

The accompanying drawings are included to provide a further understanding of the invention and are incorporated in and constitute a part of the specification. The drawings illustrate several embodiments of the invention and together with the description, serve to explain the principals of the invention. In the drawings.

A DESCRIPTION OF THE PREFERRED EMBODIMENTS

Reference will now be made in detail to the present preferred embodiments of the invention, examples of which are illustrated in the accompanying drawings.

Figure 1:
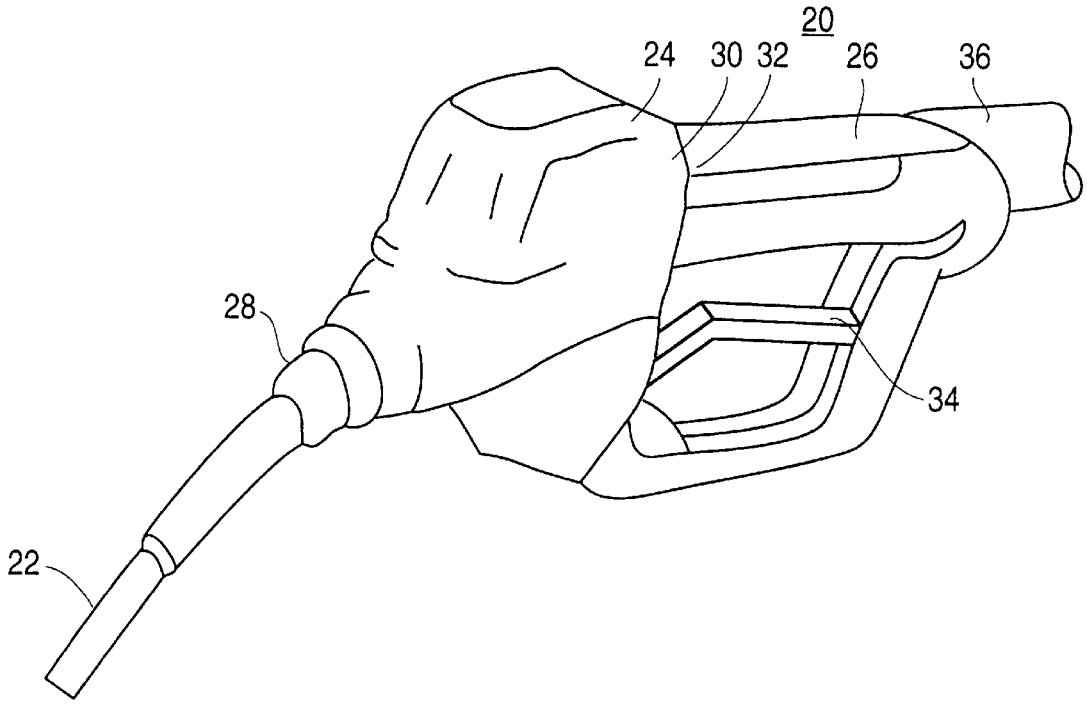
FIG. 1 is a perspective view of a conventional filler gun.

By way of background, a conventional filler gun for discharging, e.g., fuel, oil, windshield washer fluid, antifreeze, or the like, is illustrated in FIG. 1, designated generally by the reference numeral 20. As shown in FIG. 1, the filler gun 20 includes a barrel 22, a gun head 24, and a handle 26. The head 24 has a front end 28 where it joins at a junction with the barrel 22, and a rear end 30. The handle 26 has a front end 32 which joins at a junction with the rear end 30 of the head 24. The handle 26 has a lever 34 which is operatively connected to an internally located valve to control the flow of fuel from a fuel hose 36. The head 24 may be unprotected, or it may be covered by a boot 24' of rubber or plastic material.

A protective apparatus attachable to a filler gun according to the present invention comprises a protective body having an outer layer surrounding an energy absorbing inner layer.

One exemplary embodiment of the protective apparatus of the present invention is shown in FIGS. 2–5 and designated generally by reference numeral 38.

As broadly embodied herein, and referring to FIGS. 2–5, the invention according to the embodiment comprises an energy absorbing inner layer 40 surrounding a portion of the filler gun 20 to protect the filler gun 20 from impact forces. An outer layer 42 surrounds at least a portion of the inner layer 40 to distribute impact forces over the inner layer 40.

The outer layer 42 is harder than the inner layer 40 so as to resist scratching, absorb the initial impact, and distribute the forces over the softer inner layer 40.

The invention may includes attachment means for attaching the inner and outer layers 40, 42 to the filler gun 20. The attachment means may include straps, adhesives, anchors and screws, pins, or hooks. These attachment means may be used to connect multiple parts of the protective apparatus together to surround a portion of the filler gun 20, or to secure the protective apparatus to the filler gun by, for example, pushing pins contained within the protection apparatus into a boot 24' covering a head 24. A preferred attachment means utilized with either a bare head or head covered with a boot may be integrally formed into one or both of the inner and outer layers.

In one embodiment, the protective apparatus 38 is configured for use with a filler gun 20 having a boot 24' covering at least a portion of the head 24. In this embodiment, the attachment means preferably attaches the protective apparatus 38 to the boot 24'. However, the invention is not limited to use only with filler guns 20 protected by a boot 24'. The protective apparatus 38 of the present invention permits attachment either to the head 24 of a filler gun 20, or to a boot 24' covering the head 24 of the filler gun 20.

The inner and outer layers 40, 42 form a protective body 44, which may be formed from various materials, and the attachment means can be any substance or device for securing the protective body 44 to the filler gun 20. Preferably, the outer layer 42 is made of molded plastic or a substantially hard plastic. The preferred hard plastic is either polyamide or polycarbonate. Suitably, the polycarbonate could be e.g. of the make LEXAN®, MAKROLON®, GRILIAMID® or other suitable make. The outer layer 42 is configured to withstand the initial impact and to distribute the impact forces over the softer inner layer 40.

A preferred inner layer 40 is selected from at least one of rubber, foam, plastic, a bladder containing liquid, and a bladder containing gas. These materials absorb the impact forces transferred from the outer layer 40, thereby protecting the filler gun 20 from damage. For an embodiment having a bladder containing liquid, the preferred liquid would not freeze at low temperatures encountered in the region of installation. For an embodiment having a bladder containing gas, the preferred gas is air due to it being inexpensive, safe, and readily accessible at most service stations. In either embodiment having a bladder, a valve for adding or releasing the liquid or gas is preferably included. The bladder design also permits the protection apparatus to readily mold to or fit around various designs of filler guns 20.

Figure 6:
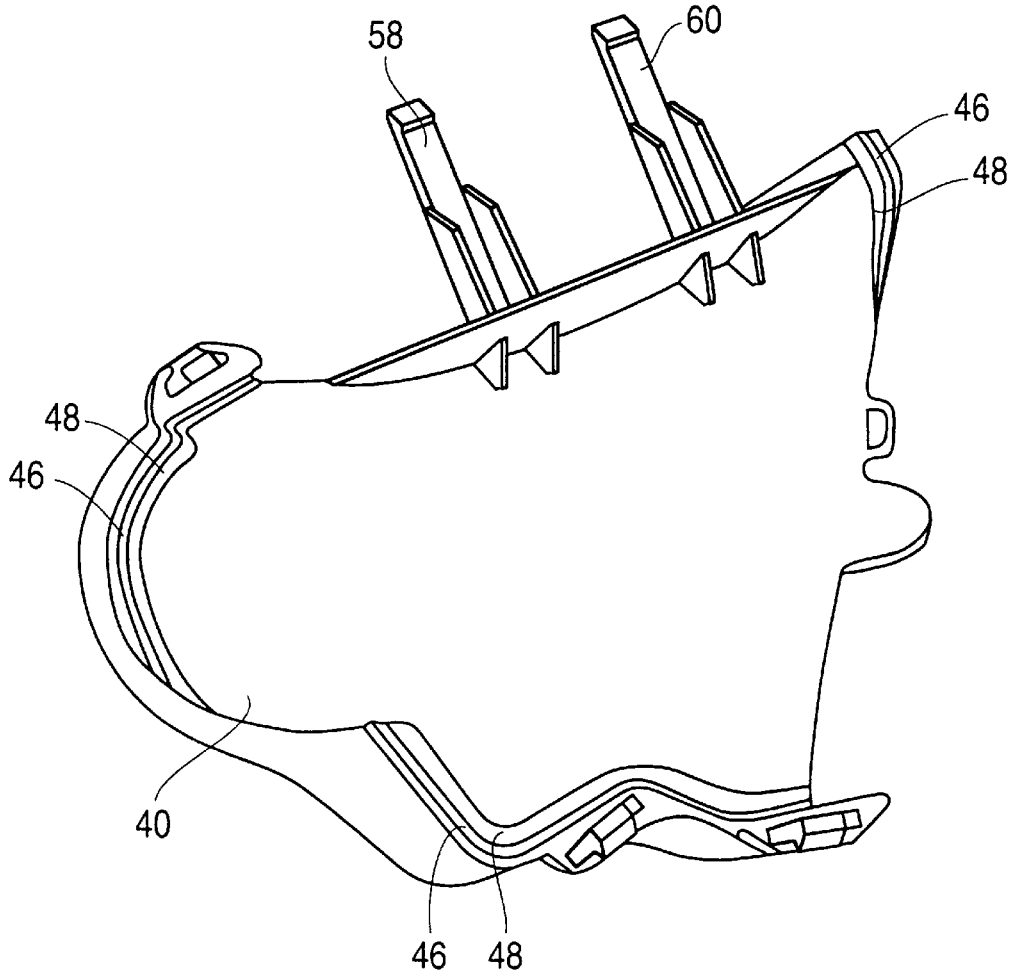
FIG. 6 is a perspective inside view of a side of a lower member according to another embodiment of the invention.

In an alternative embodiment shown in FIG. 6, the inner layer 40 includes at least two layers 46, 48 each selected from one of the above preferred materials. In this alternative embodiment the preferred two layers 46, 48 of the inner layer 40 are made of different materials.

Figure 2:
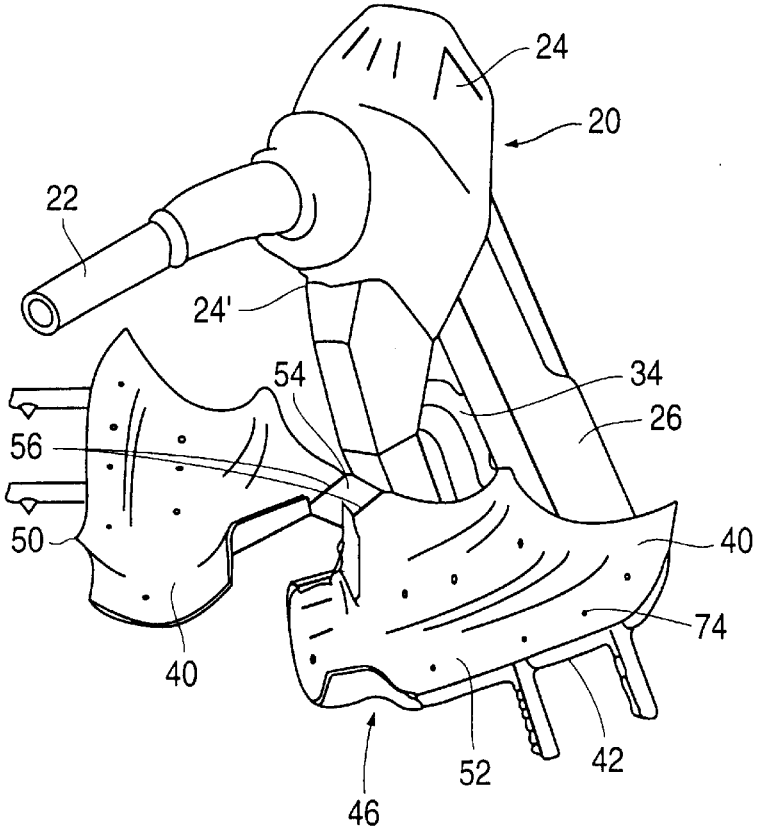
FIGS. 2 and 3 are perspective views of fitting a lower member of a protective body of a protective apparatus onto a filler gun according to one embodiment of the invention.
Figure 3:
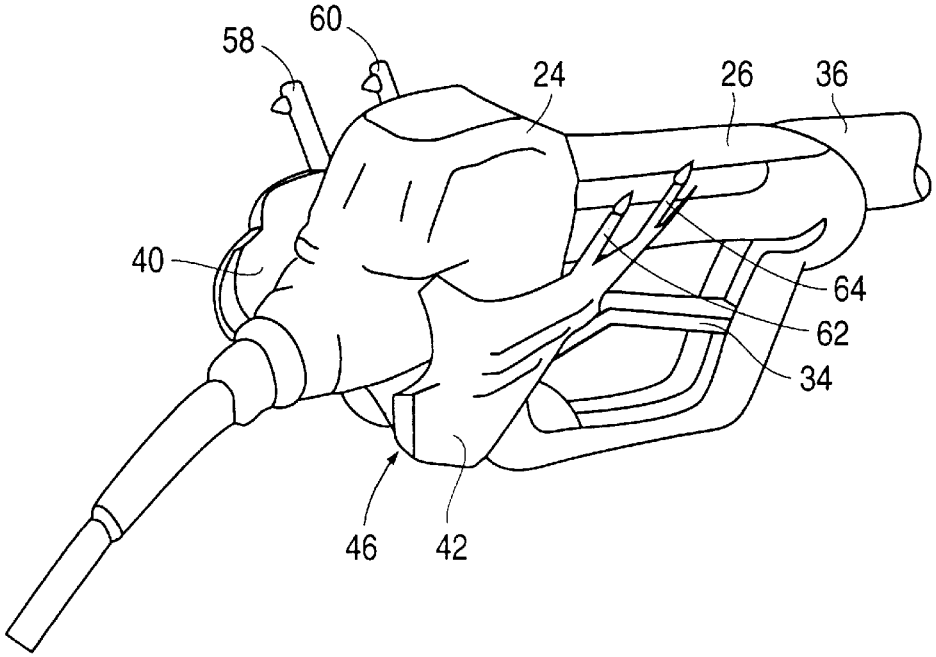

As shown in FIGS. 2–5, the protective apparatus 38 comprises a lower member 46 and an upper member 48 releasably engageable with the lower member 46. The lower member 46 has two side panels 50, 52, a bottom element 54 and device, such as film hinges 56 or the like, integrally connecting side panels 50, 52 with the bottom element 54. As shown in FIG. 3, the lower member 46 with its side panels 50, 52 and bottom element 54 are brought to lie against the gun head 24 substantially fitting around a lower part of the gun head 24. At the top region of the side panels 50, 52 there are first interlocking elements 58, 60 and 62, 64 on the respective panels 50 and 52. The first interlocking elements 58, 60, 62, 64 are suitably formed as male elements in the form of snap hooks.

Figure 4:
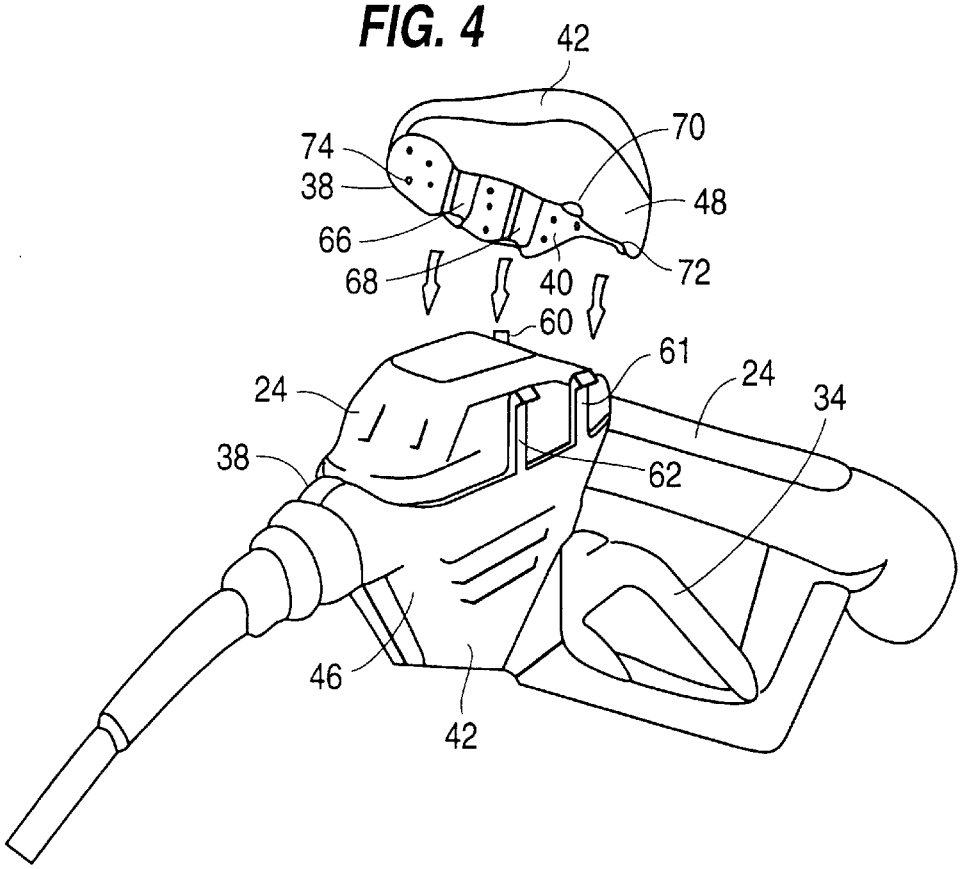
FIG. 4 is a perspective view of fitting an upper member of the protective body onto the filler gun through engagement with the lower member of FIGS. 2 and 3.
Figure 5:
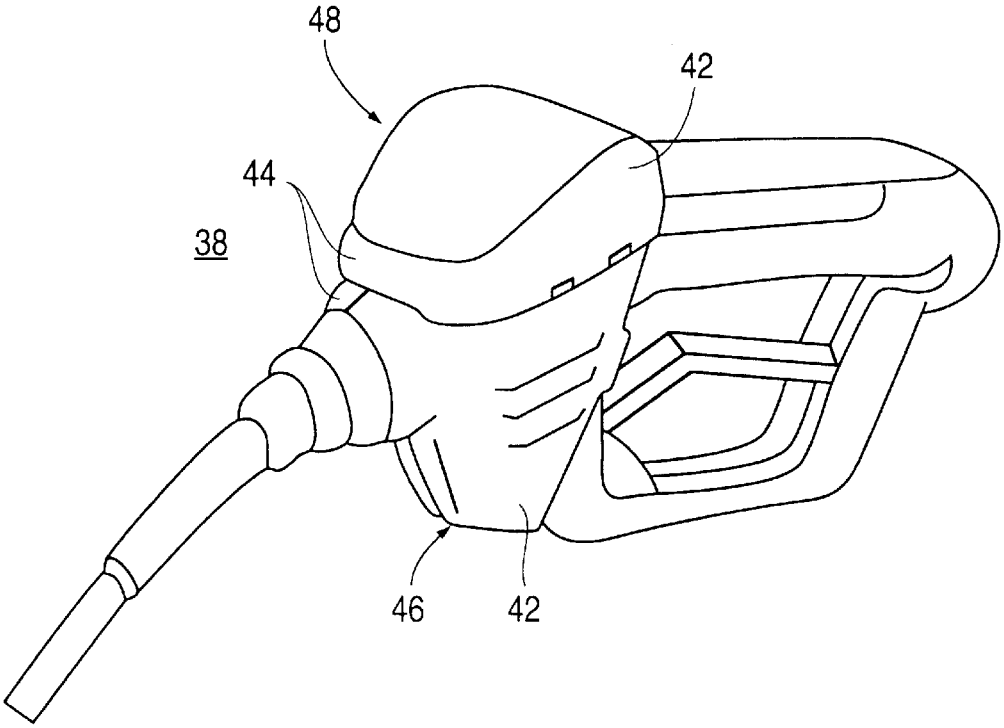
FIG. 5 is a perspective view of the protective body of FIGS. 2–4 fully installed on the filler gun.

As shown in FIG. 4, the upper member 48 is formed as a cap to fit over an upper part of the gun head 24. The upper member 48 has second interlocking elements 66, 68 and 70, 72 for releasably engaging the first interlocking elements 58, 60 and 62, 64, respectively, on the lower member 46. The second interlocking elements 66, 68, 70, 72 are formed as female elements having a ledge or set-off. FIG. 2 shows that the panels 50, 52, bottom element 54, hinge 56, and first interlocking elements 58, 60, 62, 64 are formed as an integrally made structure, e.g. through an injection molding process.

As illustrated in FIGS. 2 and 3, side panels 50, 52 may be provided with a plurality of integrally made studs 74, which are both for compensating for any tolerances in the space between the panels 50, 52 and the gun head 24 as well as being able to penetrate partly into any boot 24' provided on the gun head 24. Thus, when fitted around the gun head 24, the lower member 46 may obtain an improved contact with the gun head 24. Similarly, as shown in FIG. 4, the upper member 48 may have similar or technically equivalent space compensating studs 74. The studs should be so dimensioned that they will easily yield and/or penetrate into the soft boot 24' covering the gun head 24 if so provided.

Figure 9:
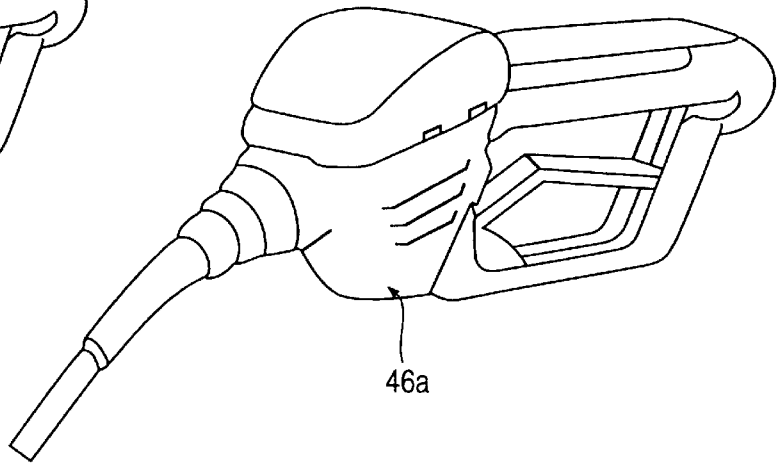

In connection with the description of FIGS. 2 and 3, it should be noted that the side panels 50, 52 at front region have edges which mate when the panels are brought to lie against the gun head 24. Until such moment, the edges are spaced apart. However, in a modified embodiment of the lower member 46, denoted by reference numeral **46*a* in FIGS. 7–9, the two side panels 50, 52 may be integrally joined at a front region thereof. Suitably, the front region of the two side panels lies above, as indicated by reference number 46', and below, as indicated by reference number 46" a front opening 46''', in the lower member 46*a*, through which the barrel 22 extends when the lower member 46*a* is brought into engagement with the gun head 24 on the filler gun 20, as illustrated in FIG. 7**.

When the lower member **46*a* is to be fitted onto gun head 24 of filler gun 20, the rear portions of the side panels 50, 52 may be pushed slightly away from each other to more easily push and enter the lower member 46*a* onto the filler gun 20. Although the outer layer 42 of the lower member 46*a* is made of a substantially hard plastic material, the inner and outer layers 40, 42 of the lower member 46*a*** may be designed such that the manipulation of the side panels is possible.

Figure 7:
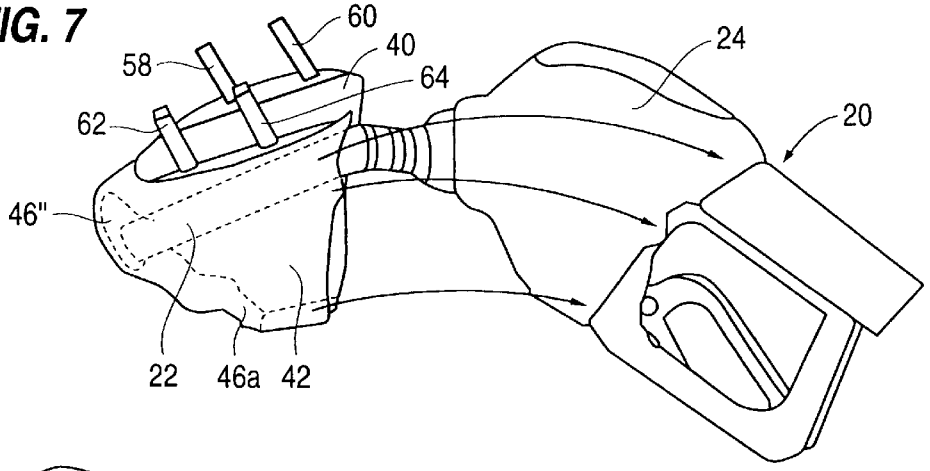
FIGS. 7–9 are perspective views of fitting of the lower member of the protective body onto the filler gun when the lower member at its front end region has its side panels integrally joined according to another embodiment of the invention.
Figure 8:
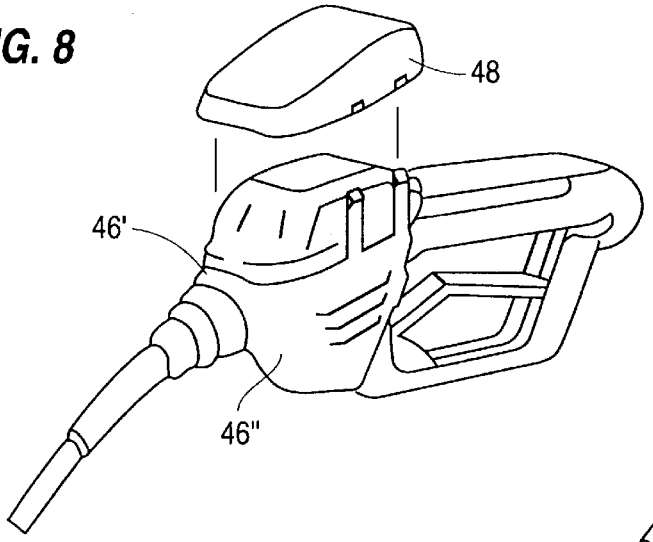
Figure 10:
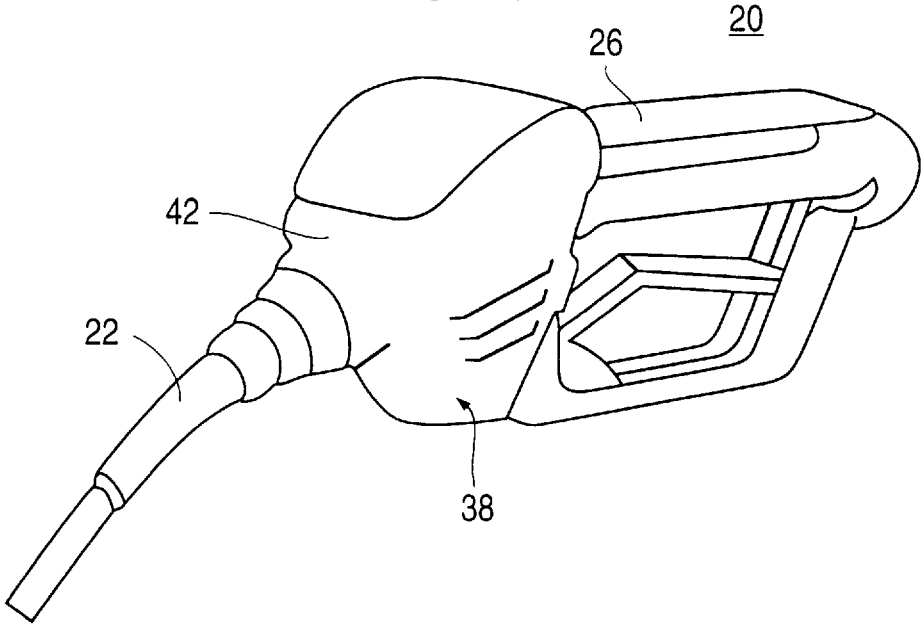
FIG. 10 is a perspective view of a protective apparatus slidably engaged with a filler gun or a boot according to yet another embodiment of the invention.

As broadly embodied herein, and referring to FIG. 10, an alternative embodiment includes a protective sleeve to slidably engage a filler gun 20 in a similar manner to lower member **46*a* of FIG. 7. The invention includes an energy absorbing inner layer 40, adapted to slidably engage the head 24, having two respective ends, one end to receive the barrel 22 and the other end to receive the handle 26. An outer layer 42 surrounds at least a portion of the inner layer 40 to distribute impact forces over the inner layer 40**.

Figure 11:
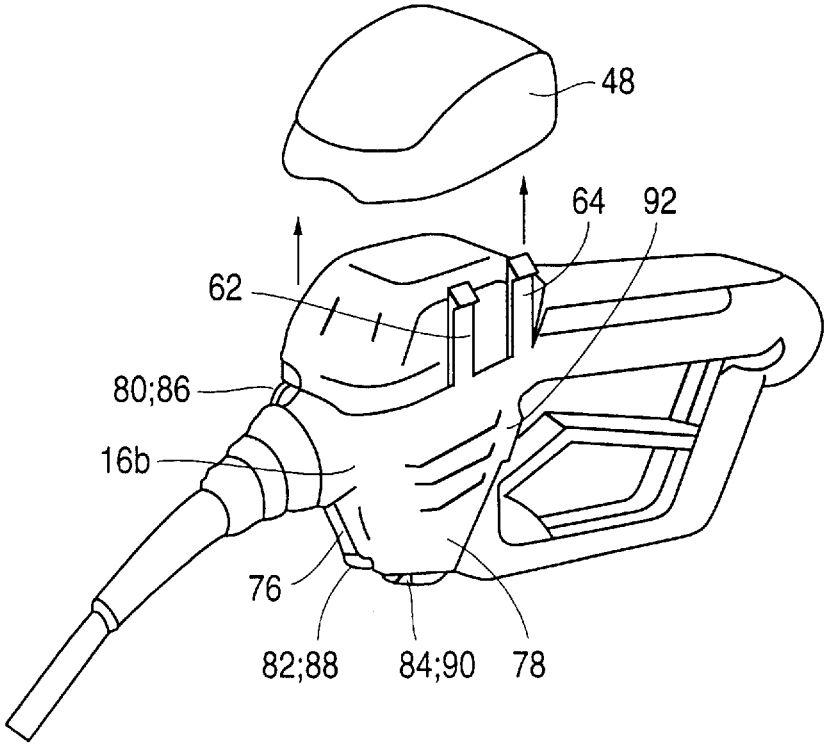
FIG. 11 is a perspective view of separate side panels of the lower member of the protective apparatus according to yet another embodiment of the invention.

The lower member **46*b* (see FIG. 11) of the protective apparatus 38, in its further modified version, comprises two side panels 76 and 78. Side panel 76 has a number of first interconnecting elements 80, 82, and 84. The number of such elements could possibly be fewer, e.g. two or be higher, for example, four. Side panel 78 has corresponding second interconnecting elements 86, 88, and 90. The first interconnecting elements 80, 82, and 84 are suitably male snap-locks. The second interconnecting elements 86, 88, and 90 are suitably female snap-locks. Apertures (not shown) may be provided next to the respective interconnecting elements for inserting conventional self-locking straps in case any of the snap-locks become defective. At the rear region of the lower member, additional apertures (not shown) may be provided for engagement with conventional self-locking straps, if so required. Rear transversely protruding members 92 are intended for engaging a rear edge region of the gun head 24**.

Figure 12:
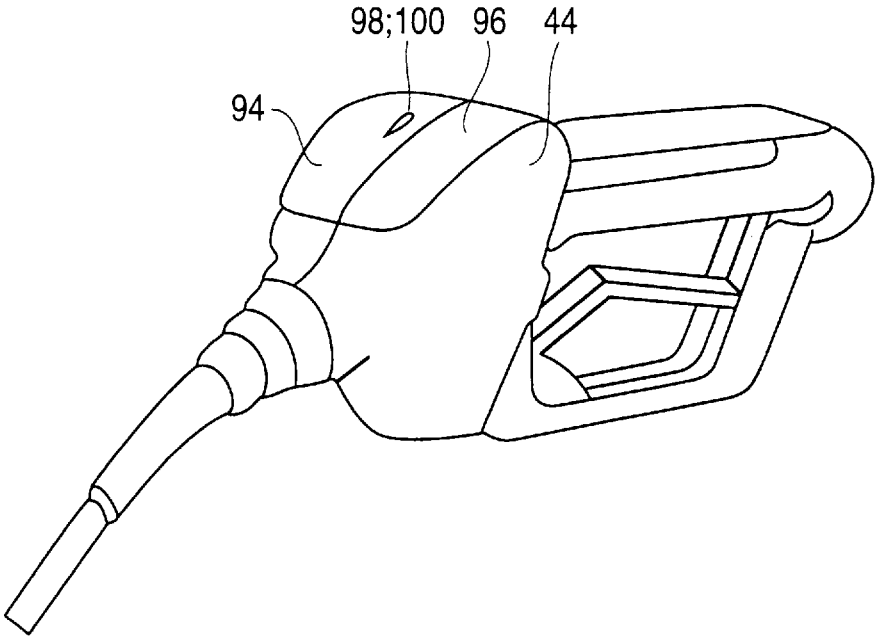
FIG. 12 is a perspective view of a protective apparatus attached to a filler gun or a boot according to yet another embodiment of the invention.

In yet another embodiment, and referring to FIG. 12, the protective body 44 has a first body portion 94 and a second body portion 96 hingedly connected together. The attachment means include a first member 98 connected to the first body portion 94 and a second member 100 connected to the second body portion 96. The first member 98 releasably engages the second member 100 to secure the protective body 44 to the filler gun 20.

Figure 13:
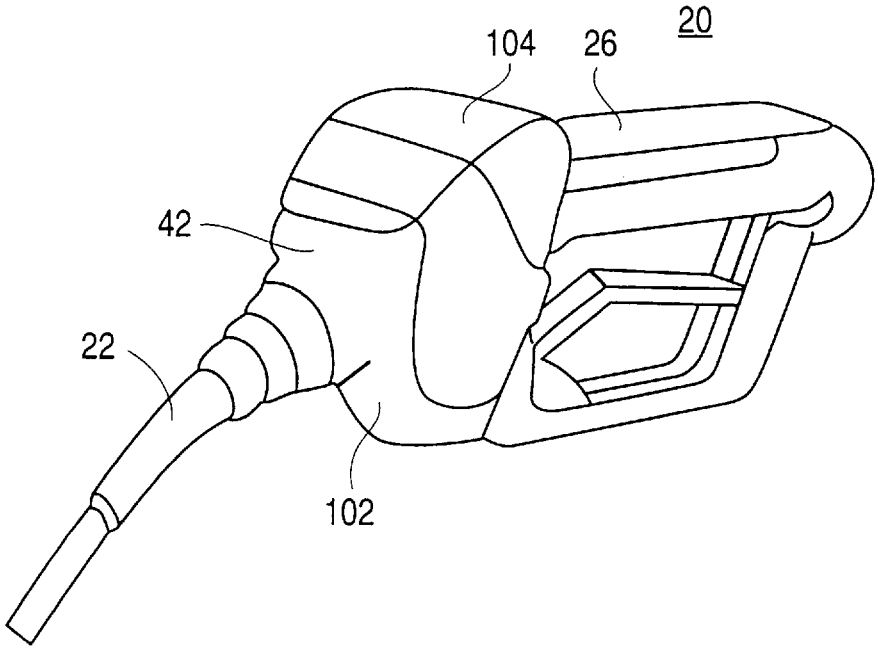
FIG. 13 is a perspective view of a protective apparatus attached to a filler gun or a boot according to another embodiment of the invention.
Figure 14:
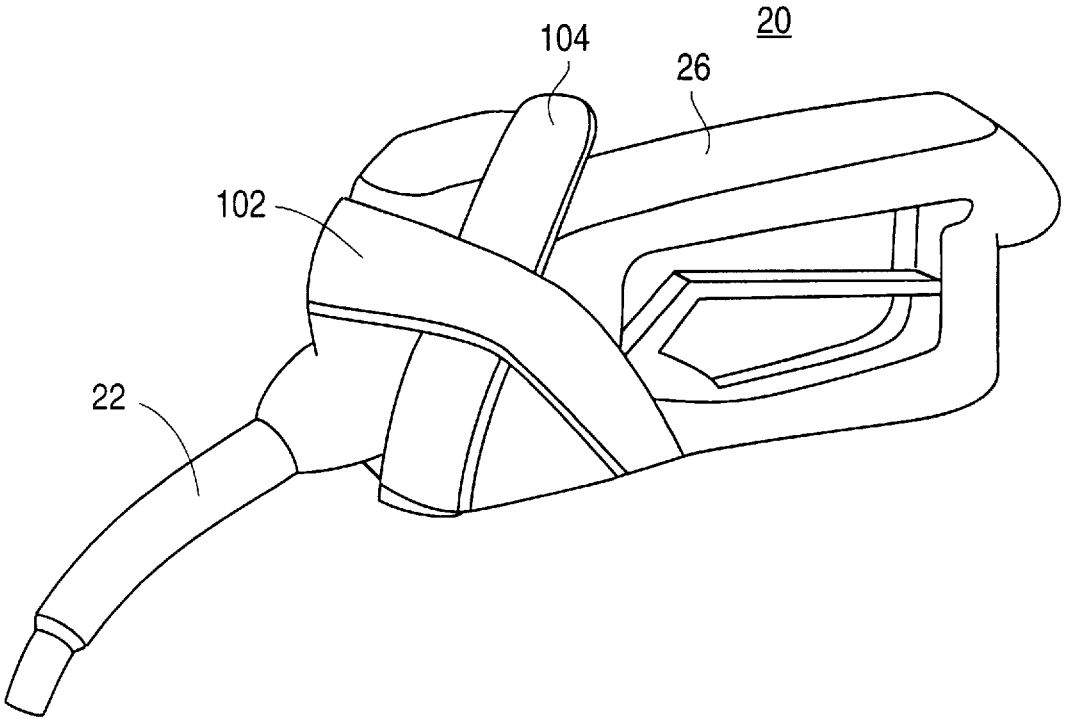
FIG. 14 is a perspective view depicting a variation on the embodiment shown in FIG. 13.

According to another embodiment, and referring to FIG. 13, the protective body 44 is divided into at least two parts 102, 104 configured to cover impact points on the filler gun 20, or to extend above the impact points. The filler gun 20 impact points are first to contact when the filler gun 20 is dropped at various angles. This embodiment offers the additional advantage of lighter weight and a lower cost. A variation on this embodiment of the invention is depicted in FIG. 14, in which parts 102 and 104 are disposed in a criss-cross configuration to cover impact points. Additional patterns are also possible.

Figure 15:
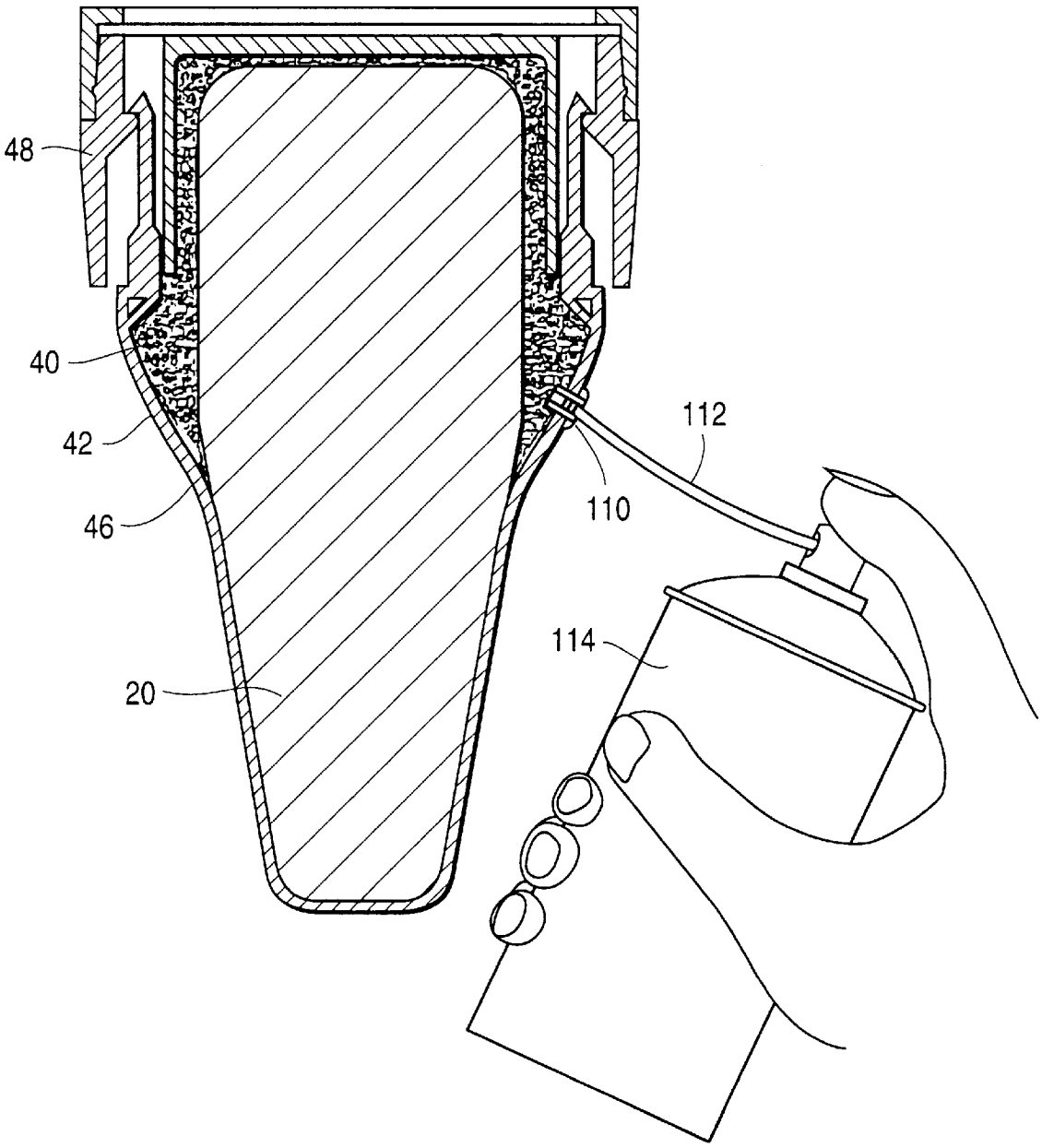
FIG. 15 depicts another embodiment of the invention including an aperture for applying the energy absorbing inner layer.

Another embodiment of the invention can be seen in FIG. 15. As embodied herein, fuel pump filler gun 20 is shown broadly in cross-section, surrounded by outer layer 42 and inner layer 40. In this embodiment, outer layer 42 includes lower member 46 and upper member 48. Lower member 46 is penetrated by a sealable aperture 110. Aperture 110 is provided to allow insertion of tube 112 of spray can 114. Spray can 114 preferably is filled with a foamed plastic material, which is sprayed beneath outer layer 42 to form the impact absorbing inner layer 40.

Figure 16:
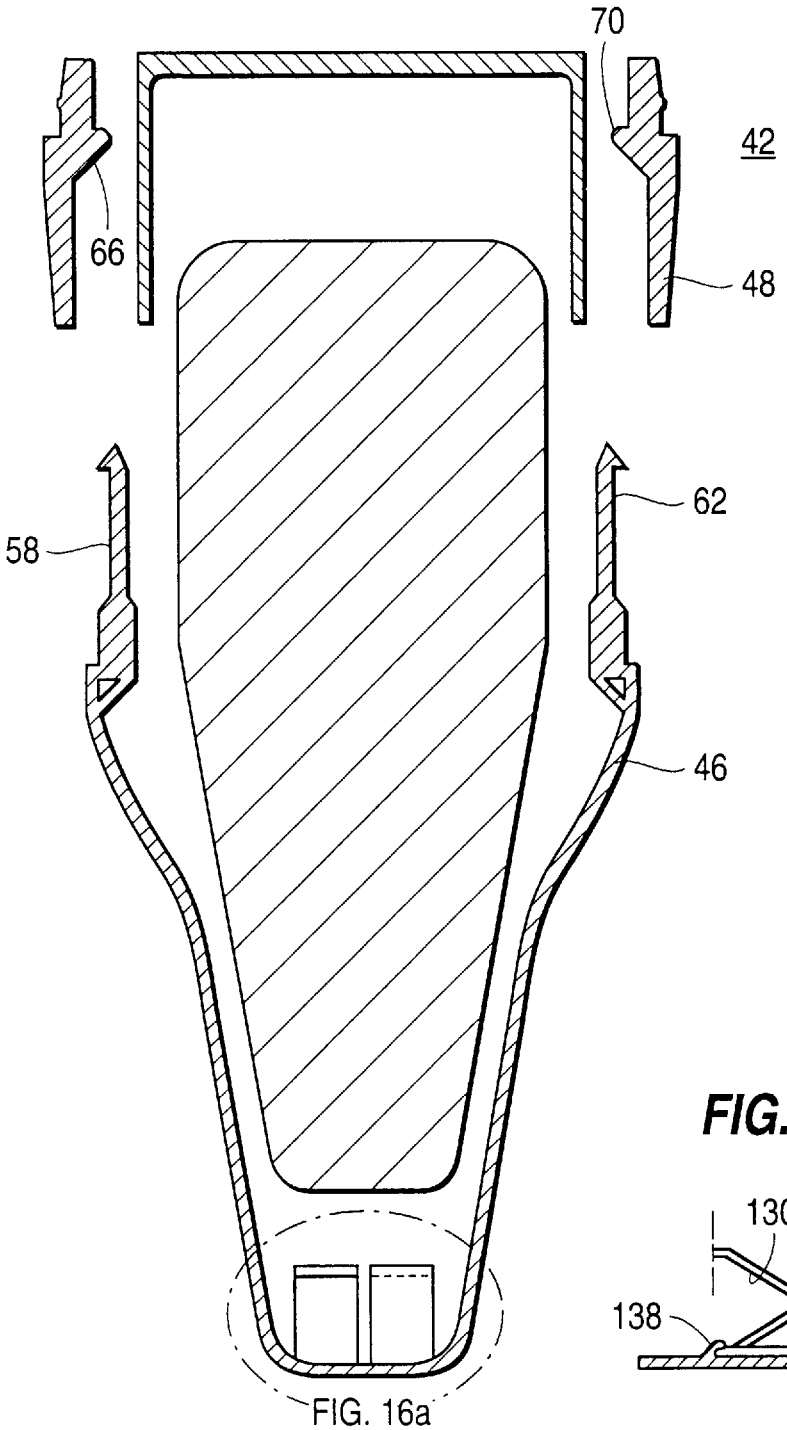
FIG. 16 is a cross-sectional front view of a filler gun and protective apparatus, with an enhanced section depicting a bottom spring in accordance with the invention.
Figure 16A:
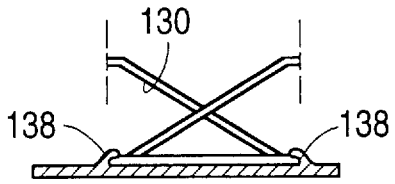
FIG. 16A is a side view of the spring depicted in FIG. 16.

An alternative embodiment of the invention is depicted in FIG. 16. In addition to an outer shell configured to surround at least a portion of the filler gun and to distribute impact forces away from the filter gun, this alternative embodiment further comprises a spring disposed between the outer layer and the filler gun to absorb direct impacts to the outer shell.

As broadly embodied in FIG. 16, outer shell 42 includes lower member 46 and upper member 48, configured to be joined together by respective interlocking elements 62, 70, and 58, 66 (other interlocking elements not shown in FIG. 16).

Figure 17:
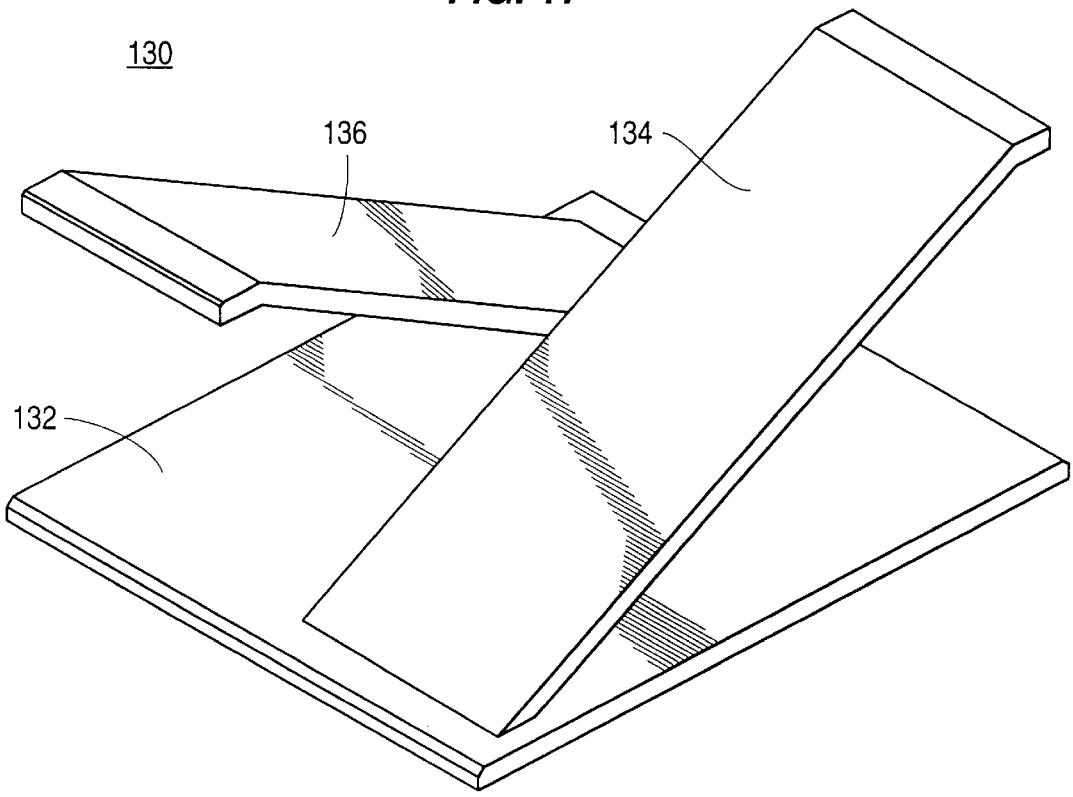
FIG. 17 is a perspective view of the bottom spring shown in FIG. 16.

A spring 130 is mounted between an inner surface of outer shell 42 and the filler gun. As shown in FIGS. 16 and 17, spring 130 includes a base portion 132 and resilient spring members 134 and 136. Lip portions 138 are molded into the inner surface of the outer shell to grip the base portion 132. As embodied in FIG. 16, spring 130 is provided in the bottom portion 46 of the outer shell. However, the invention is not limited to any precise position for the spring, or to any particular number of springs. Multiple springs can be provided at a plurality of locations.

In this embodiment, the outer shell 42 serves to broadly distribute impact forces and to protect the filler gun from scratches and the like. Spring 130, on the other hand, is provided to resiliently absorb direct impacts, such as point loads or blows, that might otherwise damage the outer shell and the filler gun.

Figure 18:
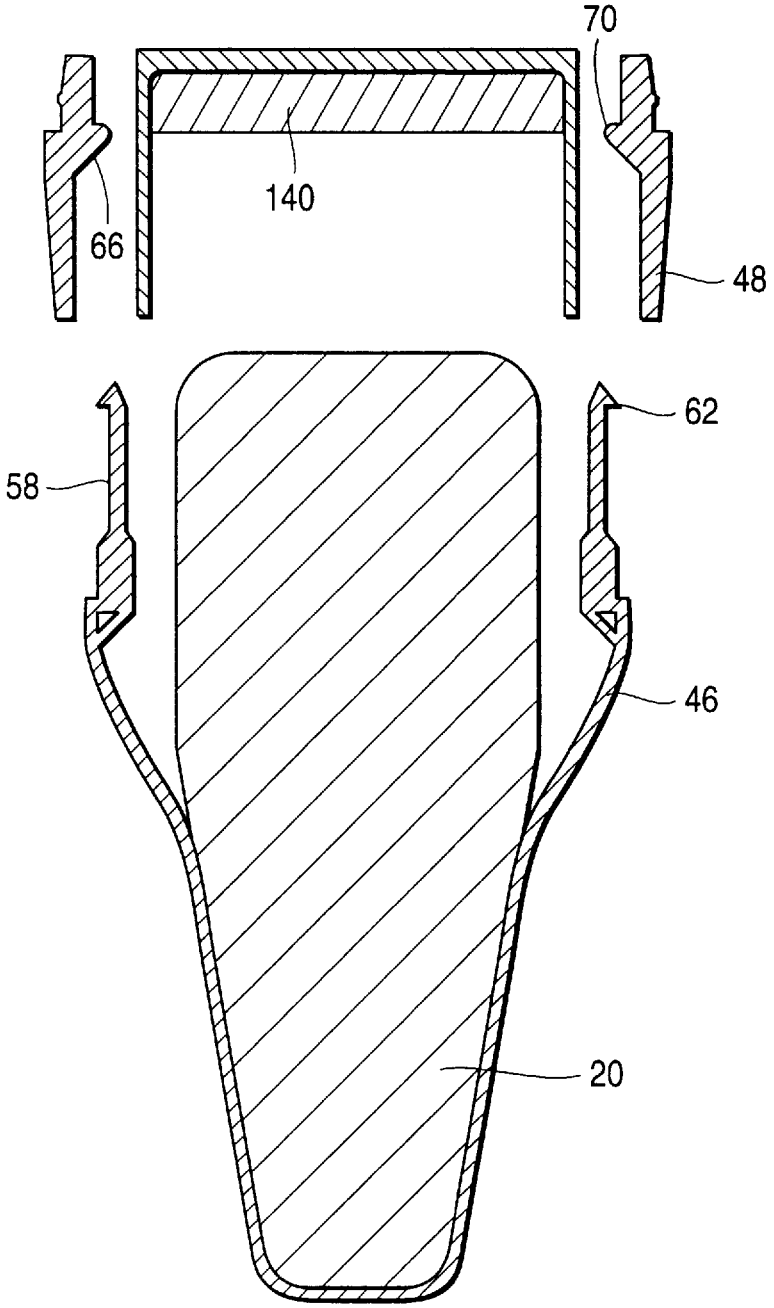
FIG. 18 is a cross-sectional front view of a filler gun and protective cover, depicting a "mattress" protective pad in the upper section of the protective cover.

FIG. 18 depicts yet another embodiment of the present invention. In this embodiment, inner layer 40 includes an upholstery material or mattress pad 140 provided inside the upper portion 48 of the outer shell.

Figure 19B:
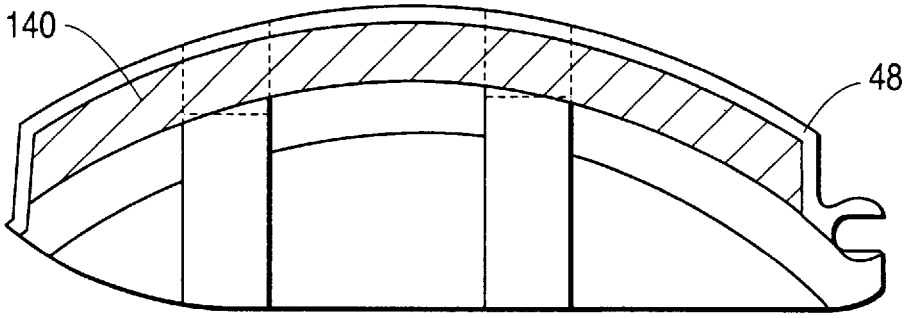
FIG. 19B is a cross-sectional side view of the upper section and "mattress" protective pad shown in FIG. 19A.
Figure 19A:
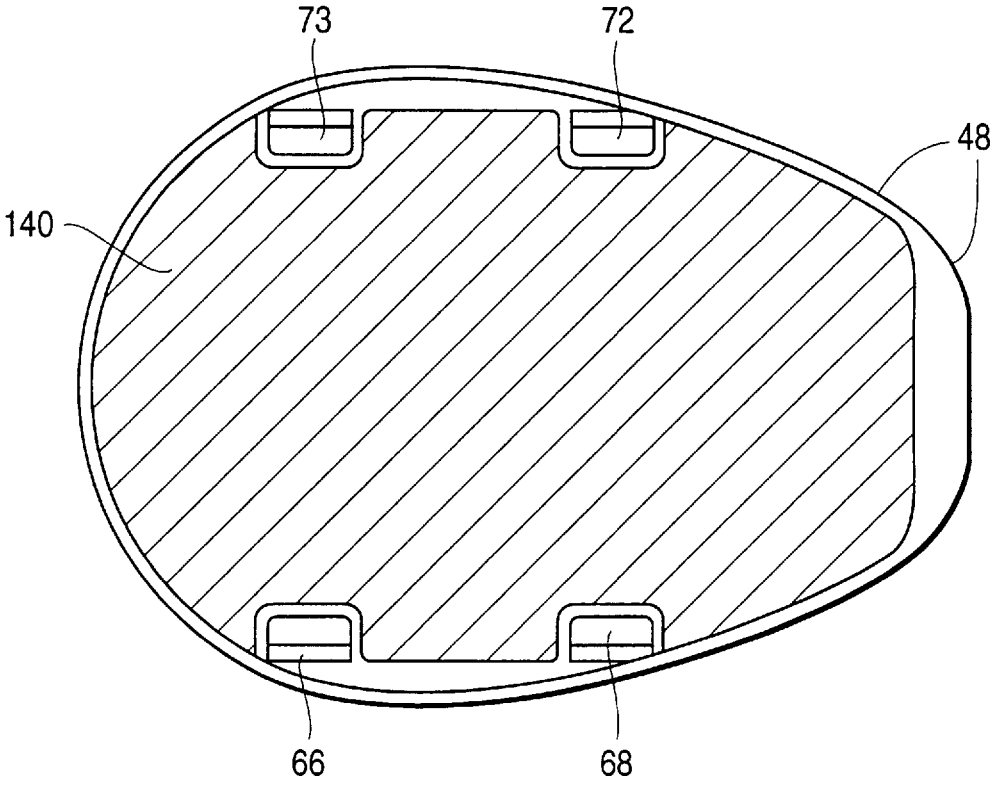
FIG. 19A is a bottom view of the "mattress" protective pad provided in the upper section of the protective cover shown in FIG. 18.

Referring to FIGS. 19A and 19B, and as discussed above, upper member 48 is formed as a generally arcuate and oval-shaped cap to fit over the upper part of gun head 24. Upholstery material 140 is attached to the inner surface of upper member 48 to have the same arcuate and generally oval configuration as the upper member.

Another embodiment of the invention is depicted in FIGS. 20–23. In this embodiment, in addition to an outer shell configured to surround at least a portion of the filler gun and to distribute impact forces away from the filler gun, a plurality of ribs are provided extending away from an inner surface of the outer shell toward the filler gun.

Figure 20:
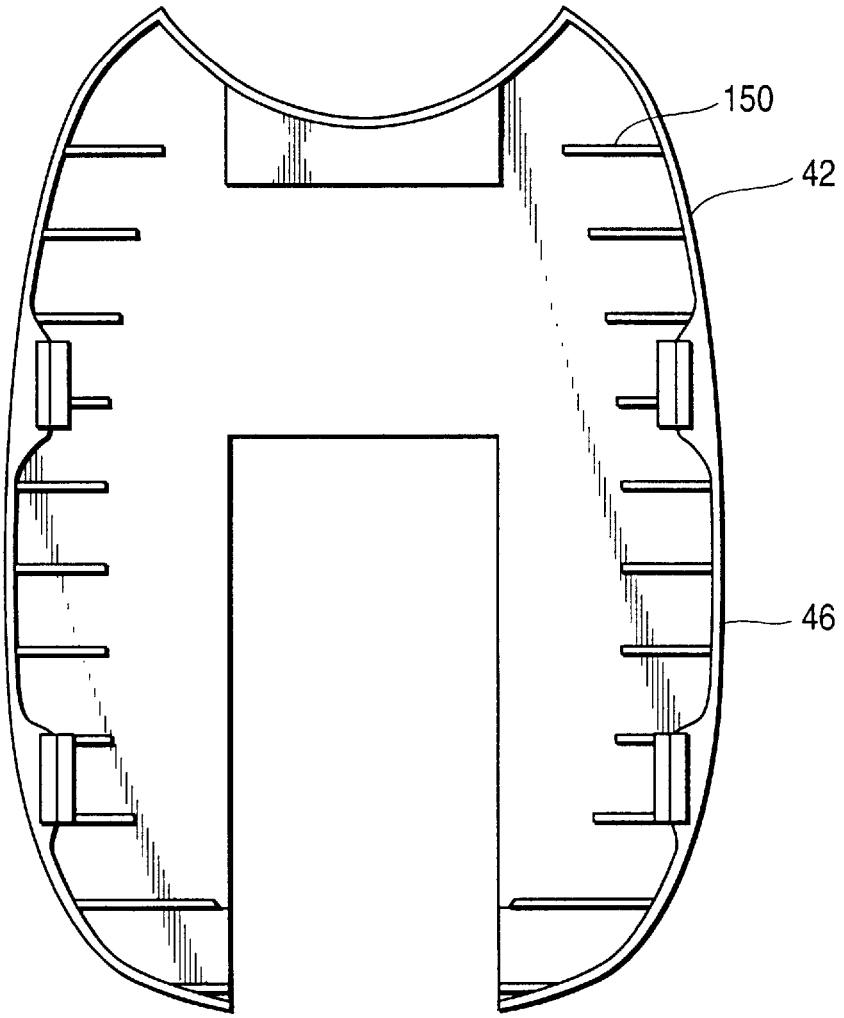
FIG. 20 is a top view of a lower portion of a protective shell, depicting yet another embodiment of a protective cover including a series of ribs.
Figure 21:
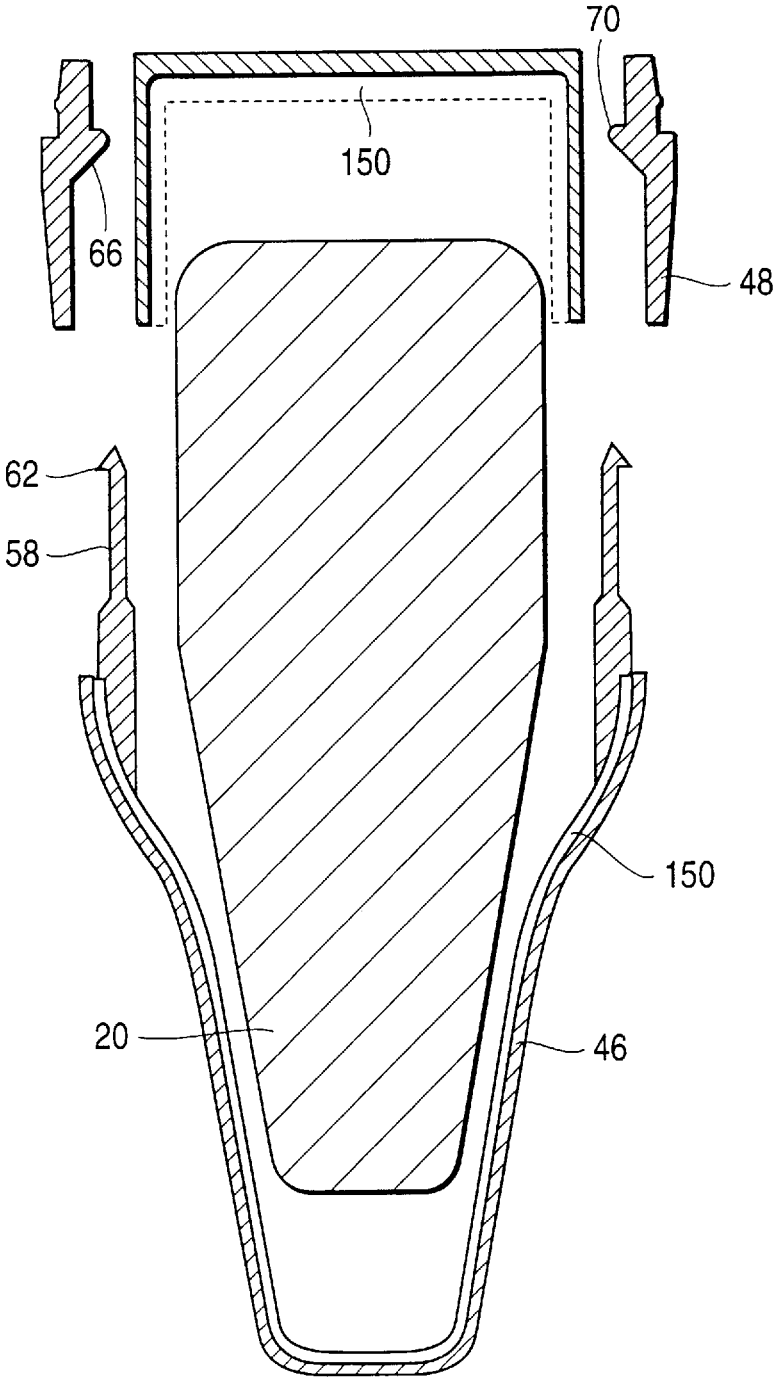
FIG. 21 is a cross-sectional front view of the ribbed embodiment of FIG. 20.
Figure 22:
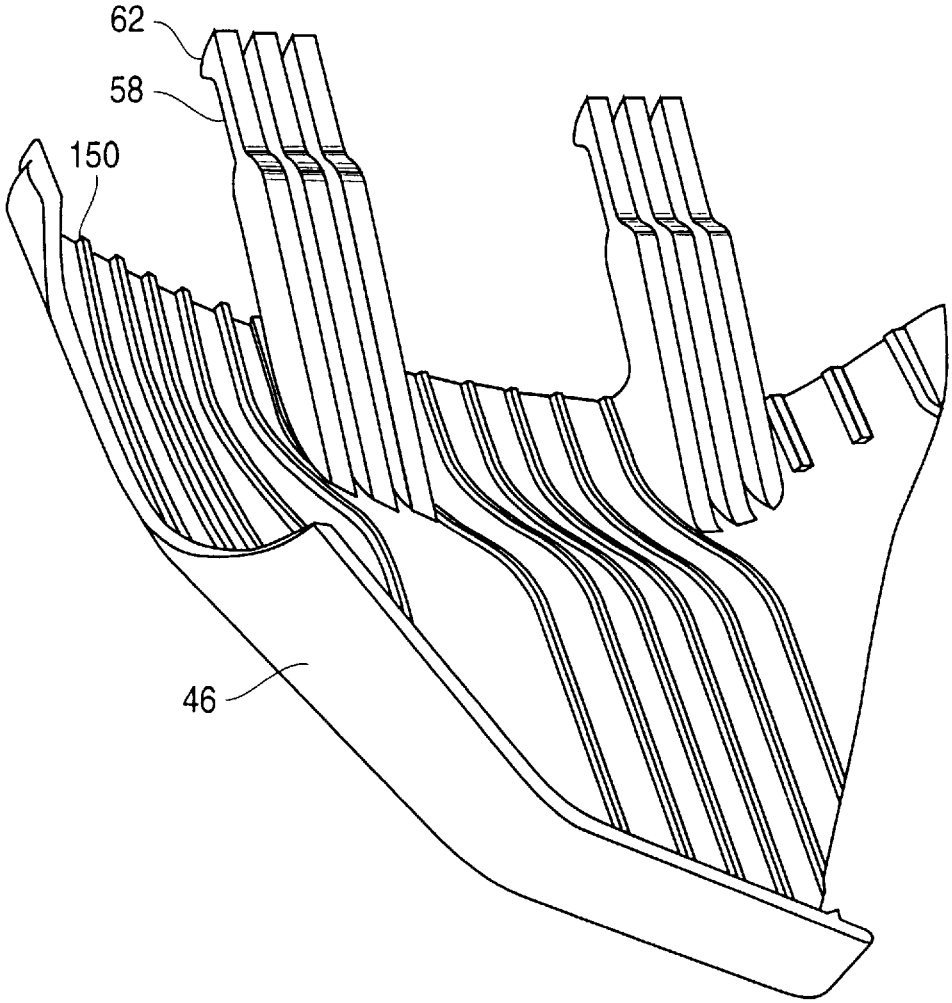
FIG. 22 is a perspective view of the lower portion of a protective shell as shown in FIG. 20.
Figure 23:
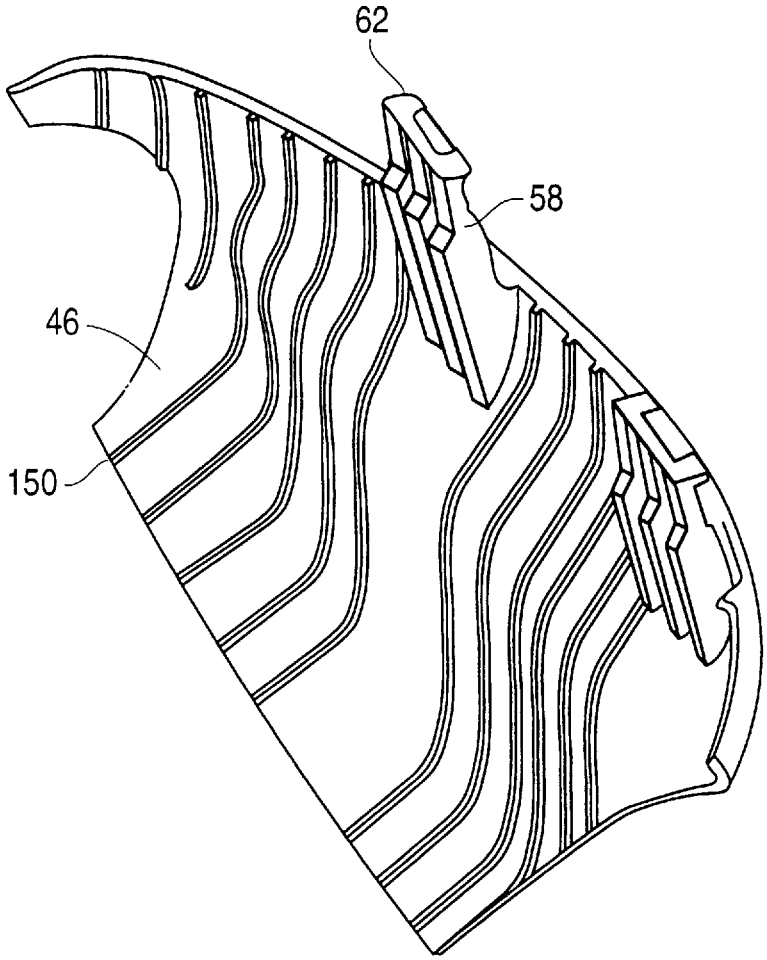
FIG. 23 is another perspective view of the embodiment shown in FIG. 22.

As broadly embodied in FIG. 20, a plurality of ribs 150 project away from the inner surface of the lower portion 46 of outer shell 42. Ribs 150 preferably are molded of the same material as outer shell 42. Alternatively, ribs may be molded separately and inserted, although this option is less practical. The ribs 150 serve multiple purposes. First, the ribs serve to assist the outer shell in absorbing and distributing impact forces away from the filler gun. Second, the ribs serve to strengthen and support the outer shell 42. Finally, the ribs can serve to position the outer shell correctly around the filler gun, by acting as spacers between the filler gun and the outer shell. As shown in FIG. 20, the ribs 150 may have different lengths, in order to work with filler gun heads of different sizes. Also, a wall thickness of the ribs will determine the "softness" of the ribs when the outer shell is subjected to an impact. In the embodiments of FIGS. 20, 22, and 23, ribs 150 extend over a substantial part of the lower portion 46. Referring to FIG. 21, ribs 150 also can be provided on the upper portion 48, although this is not required in all cases.

Figure 24:
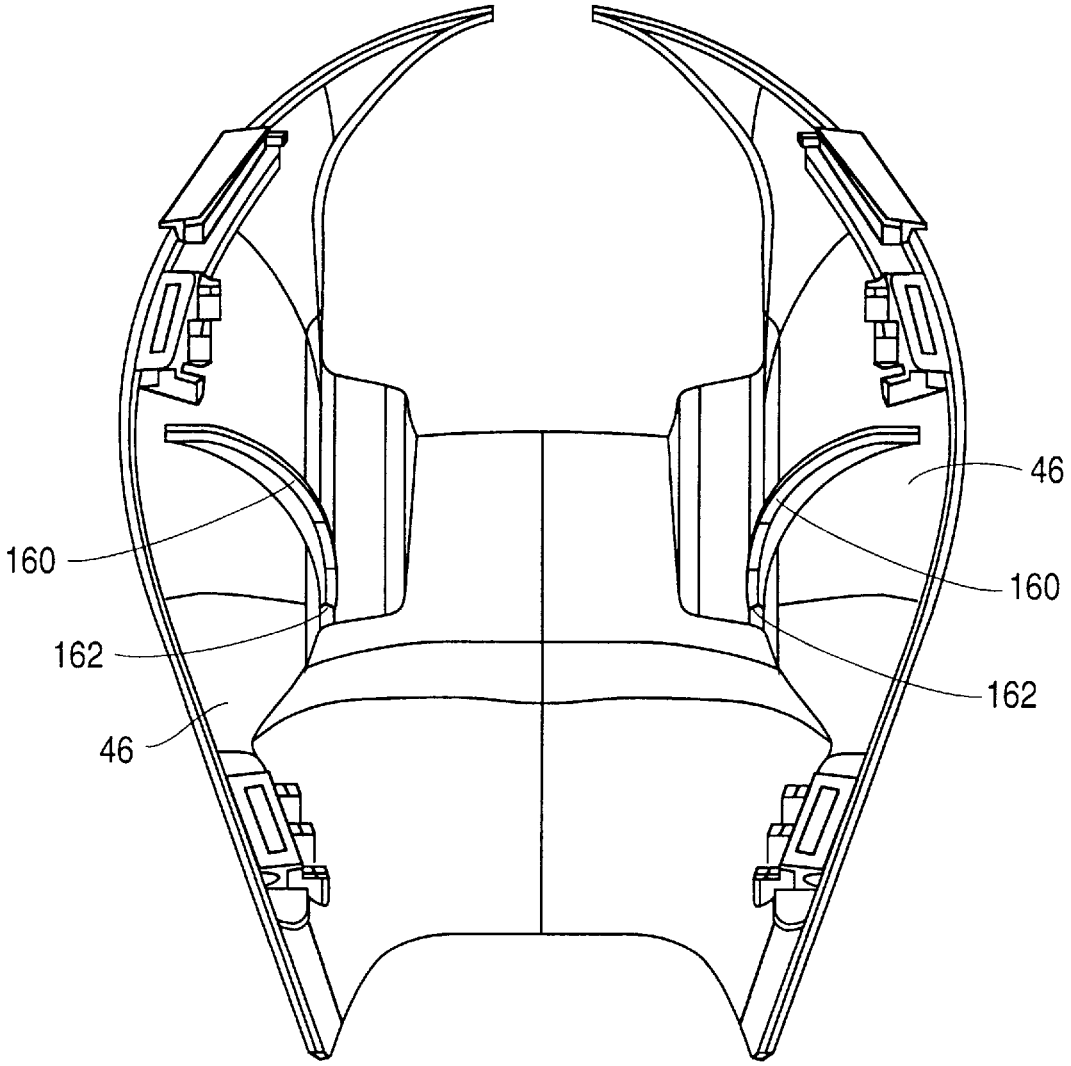
FIG. 24 is a top view of the lower portion of the protective body, having a pair of arcuate ribs projecting from an inner surface.
Figure 25:
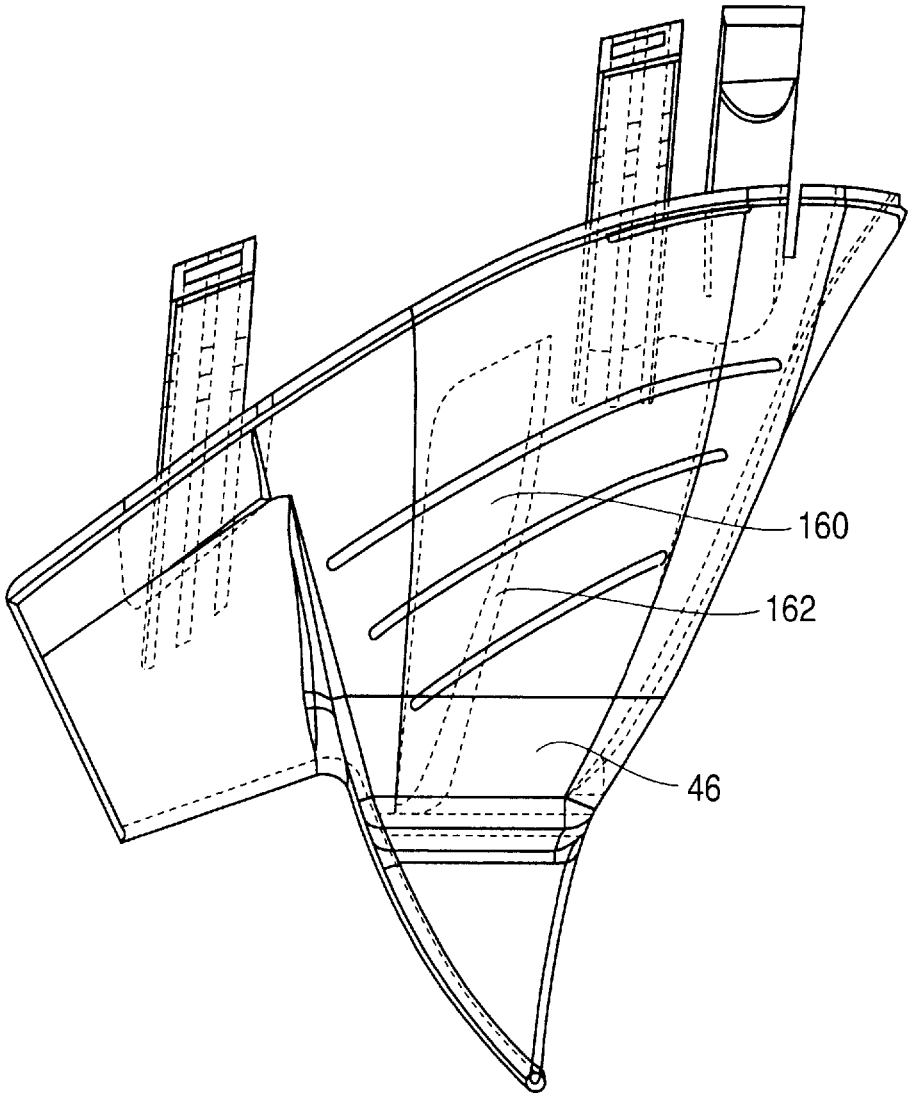
FIG. 25 is a side view of one side of the lower portion of FIG. 24, depicting one arcuate rib.
Figure 26:
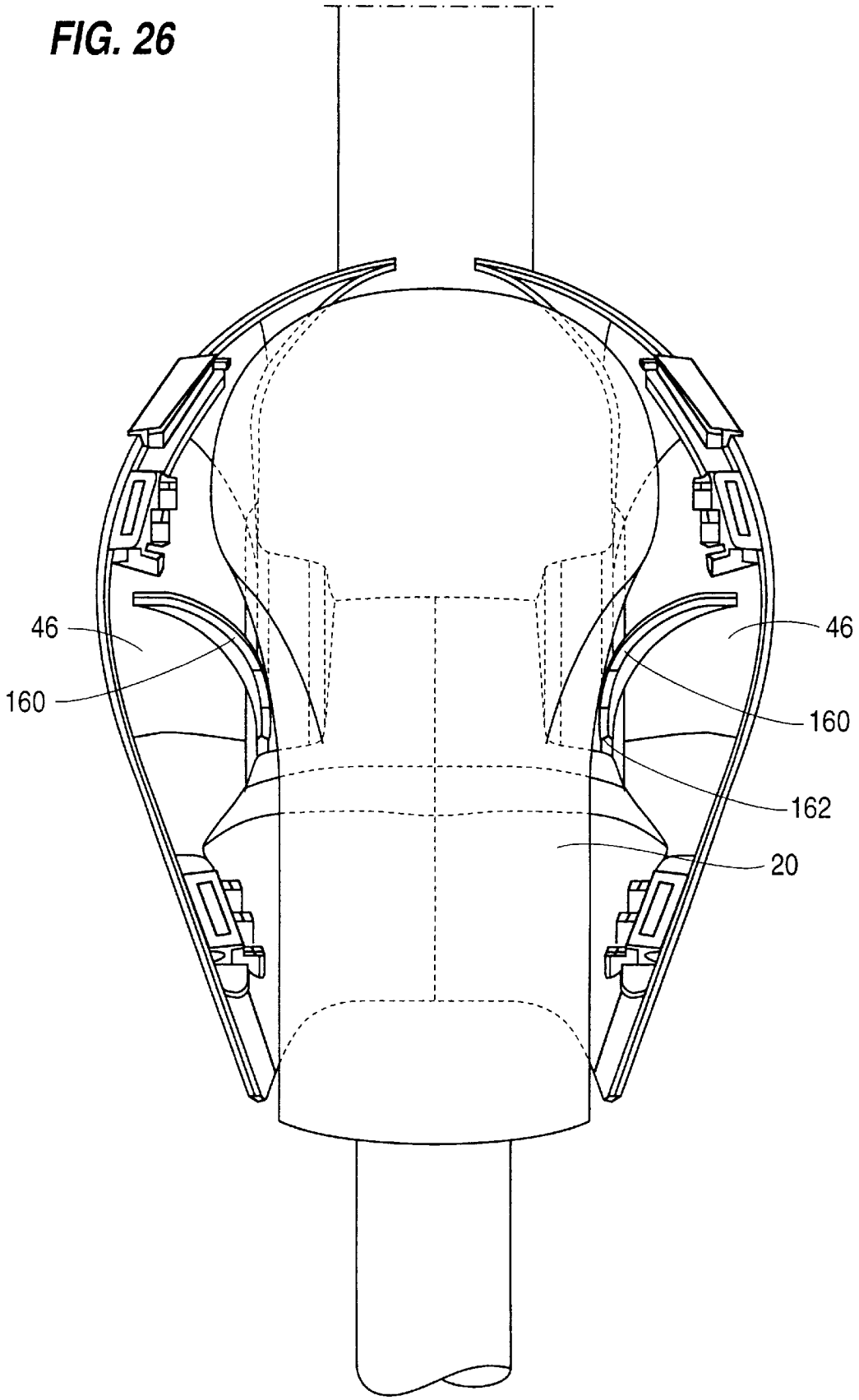
FIG. 26 is a top view similar to FIG. 24, depicting the arcuate ribs bearing against the sides of a filler gun.

Another embodiment of the present invention is depicted in FIGS. 24–26. In this embodiment a rib 160 projects from the inner surface of each respective lower portion 46 of outer shell 42. Ribs 160 preferably are molded of the same material as outer shell 42. Alternately, the ribs 160 may be molded separately and inserted into the lower portion 46.

As shown in FIGS. 24 and 25, each rib 160 projects away from the inner surface of lower portion 46, then curves, providing the rib with an arcuate cross-section, ending in a distal edge 162.

Referring to FIG. 26, the distal edges 162 of the arcuate ribs 160 bear against the side surfaces of filler gun 20. Depending on the size and design of the filler gun 20, distal edges 162 may simply contact the sides of the filler gun, or may press tightly against the sides of the filler gun, compressing the arcuate ribs 160 inwardly toward the lower portion 46 of outer shell 42. For this reason, the ribs preferably are made to be sufficiently flexible, in order to compress and accommodate various sizes of filler guns, but still be capable of springing back into position upon removal of the outer shell 42 from the filler gun.

The arcuate ribs 160 serve two purposes. First, the arcuate ribs assist the outer shell in absorbing and distributing impact forces away from the filler gun. When the filler gun is large enough to compress the arcuate rib inwardly, the rib acts like a spring, and is capable of absorbing impact force applied directly to the outer shell. Secondly, the arcuate ribs serve to position the outer shell correctly around the filler gun by acting as spacers between the filler gun and the outer shell.

While there has been illustrated and described what is at present considered to be preferred embodiments of the present invention, it will be understood by those skilled in the art that various changes and modifications may be made, and equivalents may be substituted for elements thereof, without departing from the true scope of the invention. Therefore, it is intended that this invention not be limited to the particular embodiments disclosed herein, but that the invention include all embodiments falling within the scope of the appended claims.

What is claimed is:

1. An apparatus for protecting a fuel pump filler gun, the filler gun including in sequence a barrel, a head portion, and a handle, the apparatus comprising:

a rigid outer shell configured to substantially surround only the head portion of the filler gun and to distribute impact forces away from the filler gun, the outer shell having a front end and a rear end, the rear end having an opening proximate a junction between the head portion and the handle, the handle extending through the opening such that the handle is not covered; and a resilient arcuate rib disposed between an inner surface of the outer shell and a surface of the head portion of the filler gun to assist in the distribution of the impact forces away from the filler gun.

2. The apparatus of claim 1, wherein the outer shell includes an upper portion and a lower portion, and means to connect the upper portion and the lower portion.

3. The apparatus of claim 2, wherein the arcuate rib is disposed in the lower portion of the outer shell.

4. The apparatus of claim 1, wherein the arcuate rib projects from the inner surface of the outer shell and includes a distal edge positioned to bear against a side of the filler gun.

5. The apparatus of claim 1, wherein the outer shell is made of molded plastic.

6. The apparatus of claim 1, wherein the arcuate rib is made of the same material as the outer shell.

7. The apparatus of claim 1, wherein the arcuate rib is integral with the inner surface of the outer shell.

8. The apparatus of claim 1, wherein the arcuate rib is inserted between the filler gun and the inner surface of outer shell.

9. An apparatus for protecting a fluid filler fun, the filler gun including in sequence a barrel, a head portion, and a handle, the apparatus comprising:

a rigid outer shell configured to substantially surround the head portion of the filler gun and to distribute impact forces away from the filler gun, the outer shell comprising a unitary lower portion and a unitary upper portion connectable together to define front and rear openings, the openings permitting the outer shell to be slidable into place over the head portion with the barrel projecting through the front opening and the handle projecting through the rear opening; and a resilient arcuate rib disposed between an inner surface of the outer shell and a surface of the head portion of the filler gun to assist in the distribution of the impact forces away from the filler gun.

10. The apparatus of claim 9, wherein the outer shell includes means to connect the upper portion to the lower portion.

11. The apparatus of claim 9, wherein the arcuate rib is disposed in the lower portion of the outer shell.

12. The apparatus of claim 9, wherein the arcuate rib projects from the inner surface of the outer shell and includes a distal edge positioned to bear against a side of the filler gun.

13. The apparatus of claim 9, wherein the outer shell is made of molded plastic.

14. The apparatus of claim 9, wherein the arcuate rib is made of the same material as the outer shell.

15. The apparatus of claim 9, wherein the arcuate rib is integral with the inner surface of the outer shell.

* * * * *